US007785064B2

(12) United States Patent
Bartholmey et al.

(10) Patent No.: US 7,785,064 B2
(45) Date of Patent: Aug. 31, 2010

(54) BLOWER SYSTEMS AND METHODS HAVING MULTIPLE OUTLETS

(75) Inventors: Brett Bartholmey, Bellingham, WA (US); Steve Klein, Mount Vernon, WA (US); Larry White, Anacortes, WA (US)

(73) Assignee: Dn-Eaz Products, Inc, Burlington, WA (US)

( * ) Notice: Subject to any disclaimer, the term of this patent is extended or adjusted under 35 U.S.C. 154(b) by 625 days.

(21) Appl. No.: 11/642,006

(22) Filed: Dec. 19, 2006

(65) Prior Publication Data

US 2009/0304492 A1 Dec. 10, 2009

Related U.S. Application Data

(60) Provisional application No. 60/752,697, filed on Dec. 20, 2005.

(51) Int. Cl.
*F04D 29/42* (2006.01)
*F04D 29/62* (2006.01)

(52) U.S. Cl. ..... 415/1; 415/101; 415/204; 415/206; 415/213.1

(58) Field of Classification Search ..... 415/1, 415/93, 97–101, 204, 206, 213.1, 103; 34/84, 34/90, 229, 237, 443
See application file for complete search history.

(56) References Cited

U.S. PATENT DOCUMENTS

| | | | | |
|---|---|---|---|---|
| 108,949 | A | 11/1870 | Wheeler | |
| 272,542 | A * | 2/1883 | Green | 415/99 |
| 513,057 | A * | 1/1894 | Poole | 415/97 |
| 758,303 | A | 4/1904 | Eckmann | |
| 963,277 | A * | 7/1910 | Clifford | 415/98 |
| 3,035,146 | A | 5/1962 | Pryor | |
| 3,115,567 | A | 12/1963 | Meltzer | |
| 3,145,912 | A * | 8/1964 | Weis | 415/204 |
| 3,512,898 | A * | 5/1970 | Rinker | 415/98 |
| 3,627,442 | A | 12/1971 | Brandt | |
| 3,775,029 | A | 11/1973 | Ranz | |
| 3,805,405 | A | 4/1974 | Ambos et al. | |
| 4,094,076 | A | 6/1978 | Baslow | |
| 4,145,821 | A | 3/1979 | Schantz | |

(Continued)

FOREIGN PATENT DOCUMENTS

| | | | |
|---|---|---|---|
| GB | 2227943 | A | 8/1990 |
| GB | 2397366 | A | 7/2004 |
| GB | 2423810 | A | 9/2006 |
| JP | 2004261788 | A | 9/2004 |
| SU | 1709951 | A1 | 2/1992 |
| WO | WO-8900622 | A1 | 1/1989 |

OTHER PUBLICATIONS

Dri-Eaz, Product Catalog, Jan. 1, 2002, pp. 4-7 and 14, Burlington, Washington, U.S.

(Continued)

*Primary Examiner*—Christopher Verdier
(74) *Attorney, Agent, or Firm*—Perkins Coie LLP

(57) ABSTRACT

A blower system comprising a housing and a fan assembly. The housing defines a housing chamber, at least one inlet opening, a primary outlet opening, and a secondary outlet opening. The fan assembly is mounted within the housing chamber. Operation of the fan assembly draws air into the housing chamber through the at least one inlet opening and forces air out of the housing chamber through at least one of the primary outlet opening and the secondary outlet opening.

18 Claims, 3 Drawing Sheets

U.S. PATENT DOCUMENTS

| | | | | |
|---|---|---|---|---|
| 4,151,658 | A | | 5/1979 | Hibino et al. |
| D254,566 | S | | 3/1980 | Cummins |
| 4,572,188 | A | | 2/1986 | Augustine et al. |
| 4,777,737 | A | | 10/1988 | Wolens et al. |
| 5,014,446 | A | | 5/1991 | Reesman |
| 5,048,202 | A | * | 9/1991 | Shero ..... 34/90 |
| 5,155,924 | A | | 10/1992 | Smith |
| 5,174,048 | A | | 12/1992 | Shero |
| 5,257,467 | A | | 11/1993 | White |
| 5,265,895 | A | | 11/1993 | Barrett |
| 5,388,958 | A | | 2/1995 | Dinh |
| 5,405,370 | A | | 4/1995 | Irani |
| 5,408,759 | A | | 4/1995 | Bass |
| 5,555,643 | A | | 9/1996 | Guasch |
| 5,893,216 | A | | 4/1999 | Smith et al. |
| 5,980,207 | A | | 11/1999 | Correll |
| 6,039,532 | A | | 3/2000 | McConnell |
| D422,351 | S | | 4/2000 | Griffin |
| 6,186,857 | B1 | | 2/2001 | Gazit et al. |
| D440,298 | S | | 4/2001 | Wolfe |
| D442,740 | S | | 5/2001 | Wolfe |
| 6,298,578 | B1 | * | 10/2001 | Frampton ..... 34/443 |
| 6,401,354 | B1 | | 6/2002 | Johnson |
| 6,609,893 | B2 | | 8/2003 | Dobrzeniecki |
| D480,467 | S | | 10/2003 | White |
| D517,677 | S | | 3/2006 | Bartholmey |
| 7,007,403 | B1 | | 3/2006 | Studebaker |
| 7,201,563 | B2 | | 4/2007 | Studebaker |
| 2004/0255484 | A1 | | 12/2004 | Storrer et al. |
| 2006/0186225 | A1 | | 8/2006 | Bartholmey et al. |
| 2007/0080512 | A1 | | 4/2007 | Bartholmey et al. |

OTHER PUBLICATIONS

Dri-Eaz, Product Catalog, Jan. 1, 2002, pp. 9-12; Burlington, Washington, U.S.

Dri-Eaz, Product Catalog, Jan. 1, 2003, p. 10, Burlington, Washington, U.S.

Jon-Don; Gale Force Air Mover from Dry-Air at Jon-Don; www.jondon.com/galeforce/; Mar. 2003, 3 pages.

* cited by examiner

BLOWER SYSTEMS AND METHODS HAVING MULTIPLE OUTLETS

RELATED APPLICATIONS

This application claims priority of U.S. Provisional Patent Application Ser. No. 60/752,697 filed Dec. 20, 2005, the contents of which are incorporated herein by reference.

TECHNICAL FIELD

The present invention generally relates to blower systems and, more specifically, to blower systems adapted to remove moisture from structures.

BACKGROUND OF THE INVENTION

For many reasons, water may leak, flood, or otherwise enter a dwelling such as a commercial or residential building. If such water is not relatively quickly removed from the building, the water can damage components of the building such as the floor materials and/or interior walls. Restorative drying may be defined as the controlled removal of moisture from building contents and components to alleviate or eliminate water damage.

The field of restorative drying often employs the movement of air along the surface of wet materials. For example, a blower or air mover may be configured to direct a stream of air along a floor surface to remove moisture from the carpet defining the floor surface.

Blowers and air movers typically comprise a housing that contains a motor and fan blade. The motor rotates the fan blade to draw air into the housing through one or more inlets and then out of the housing through an outlet defined by the housing. The outlet is typically an elongate opening formed in one wall of the housing adjacent to a corner of the housing. To dry a floor, the housing would typically be arranged at a desired location on the floor so that the stream of air exiting the outlet moves along the floor surface. Often, a plurality (two or more) of blowers or air movers is provided to decrease drying time.

The housing of the blower or air mover typically occupies a portion of the floor surface. Accordingly, even though a plurality of air movers may be used, these air movers are typically repositioned at least once to allow the portion of the floor surface occupied by the housing or housings to be dried. The repositioning of the air movers can significantly increase the amount of time required to dry a given floor area.

The need thus exists for improved blowers and air movers that do not require repositioning to allow the area under the housing to be dried.

SUMMARY OF THE INVENTION

The present invention may be embodied as a blower system comprising a housing and a fan assembly. The housing defines a housing chamber, at least one inlet opening, a primary outlet opening, and a secondary outlet opening. The fan assembly is mounted within the housing chamber. Operation of the fan assembly draws air into the housing chamber through the at least one inlet opening and forces air out of the housing chamber through at least one of the primary outlet opening and the secondary outlet opening.

The present invention may also be embodied as a method of causing air to flow along a target surface comprising the following steps. A housing is provided, where the housing defines a housing chamber, at least one inlet opening, a primary outlet opening, and a secondary outlet opening. A fan assembly is arranged within the housing chamber. The housing is arranged on the target surface. The fan assembly is operated such that air is drawn into the housing chamber through the at least one inlet opening and forced air out of the housing chamber through the primary outlet opening and the secondary outlet opening.

DETAILED DESCRIPTION OF THE INVENTION

Figure 1:
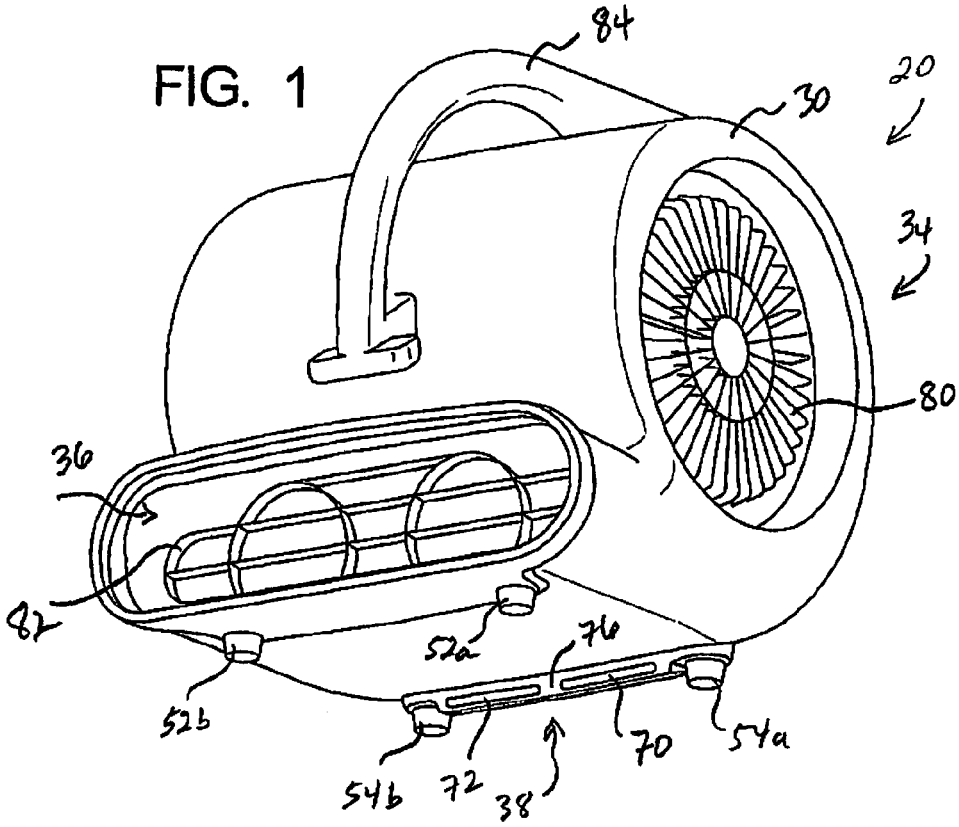
FIG. 1 is a bottom perspective view of an example blower system of the present invention.

FIGS. 1-5 of the drawing illustrate an example blower system 20 constructed in accordance with, and embodying, the principles of the present invention. As perhaps best shown in FIG. 5, the blower system 20 comprises a housing assembly 22 and a fan assembly 24. The fan assembly 24 is located within the housing assembly 22, and operation of the fan assembly 24 displaces air such that air moves relative to the housing assembly 22. The fan assembly 24 is or may be conventional, and the details of operation and construction of the fan assembly 24 will not be described in detail herein.

In the following discussion, the terms "front" and "rear" and the like refer to the directions to the left and right, respectively, in FIGS. 2-5. The terms "up" and "down" and the like refer to the directions to the top and bottom, respectively, in FIGS. 2 and 5.

The housing assembly 22 comprises a housing structure 30 defining a housing chamber 32. The housing structure 30 further defines an inlet opening 34, a primary outlet opening 36, and a secondary outlet opening 38. The fan assembly 24 is mounted within the housing assembly 22 such that air is drawn into the housing chamber 32 through the inlet opening 34 and forced out of the housing chamber 32 through the primary outlet opening 36 and the secondary opening 38.

During normal use, part of the air displaced by the fan assembly 24 flows out of the primary outlet opening 36 and part of this air flows out of the secondary outlet opening 38. In the example blower system 20, a large proportion of the air displaced by the fan assembly 24 flows out of the primary outlet opening 36 in front of the blower system 20, while a small proportion of the air displaced by the fan assembly 24 flows out of the secondary outlet opening 38 underneath the blower system 20.

The air flowing out of the primary outlet opening 36 thus accelerates the drying of materials in front of the blower system 20, while air flowing out of the secondary outlet opening 38 accelerates the drying of materials underneath the blower system 20.

With the foregoing general understanding of the operation of the example blower system 20 of the present invention, the details of construction and operation of the example blower system 20 will now be described in further detail.

Figure 2:
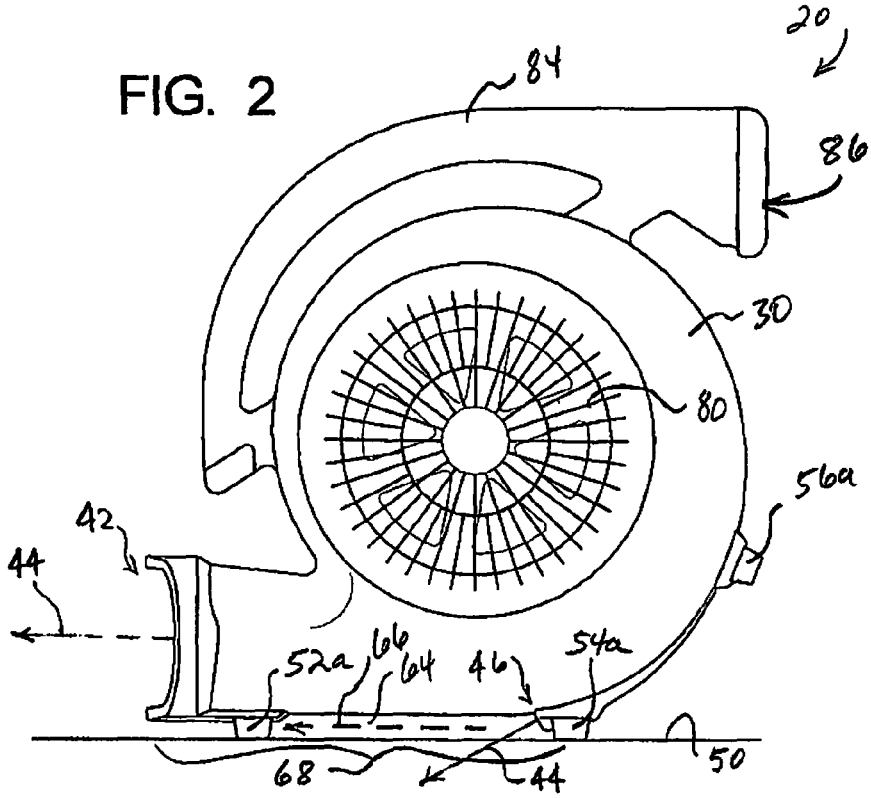
FIG. 2 is a side elevation view of the blower system of FIG. 1, the opposite side view being a mirror image.
Figure 3:
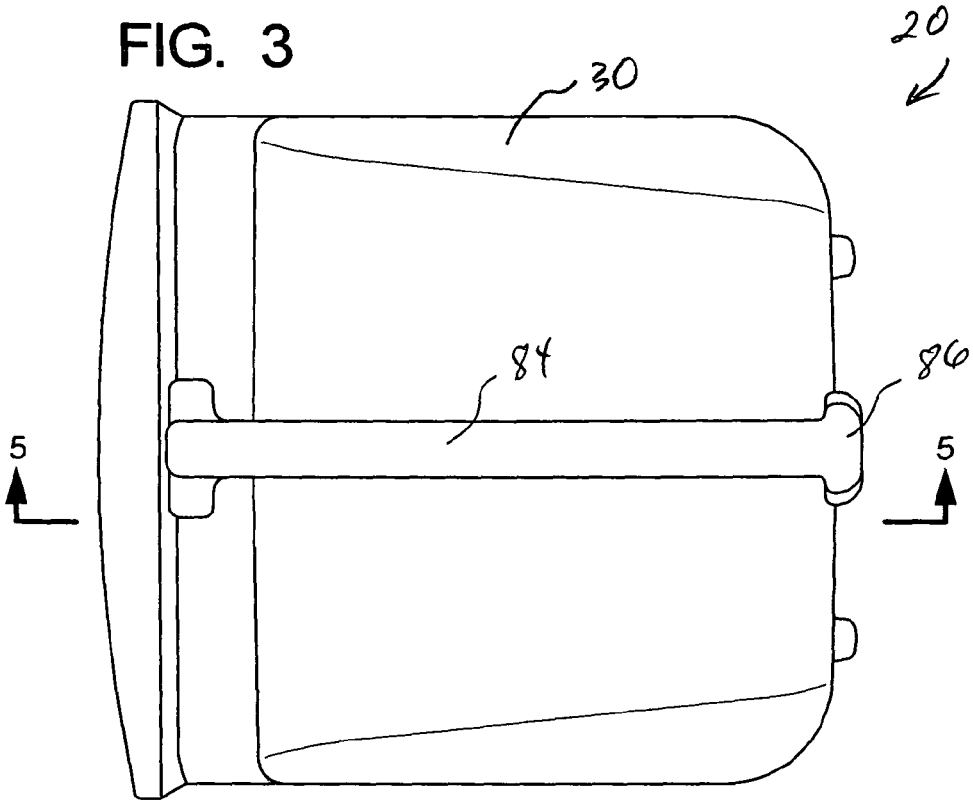
FIG. 3 is a top plan view of the blower system of FIG. 1.
Figure 5:
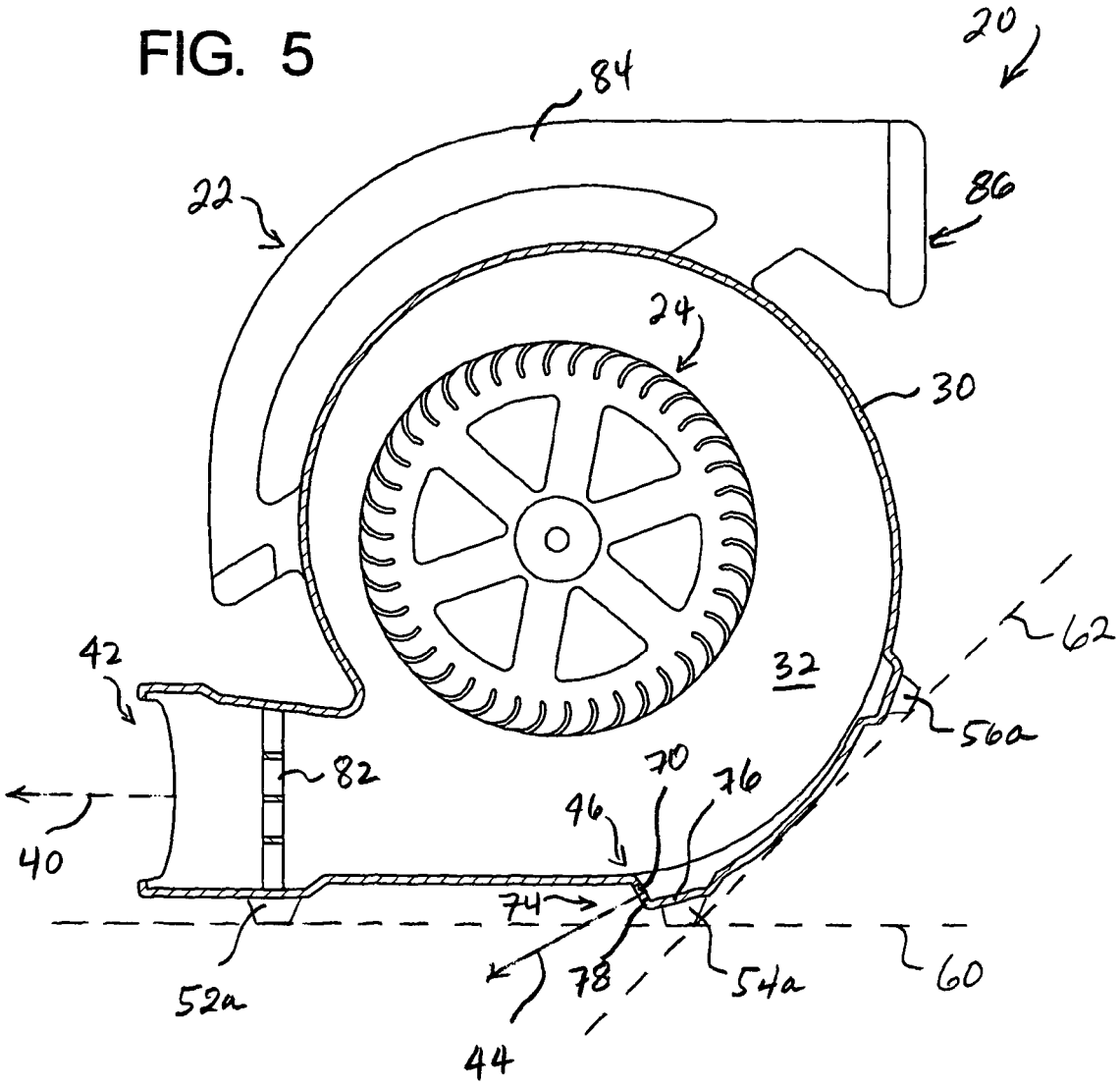
FIG. 5 is a section view taken along lines 5-5 in FIG. 3.

Referring now to FIGS. 2 and 5, it can be seen that the example housing structure 30 is configured such that air flows out of the primary outlet opening 36 along a first flow axis 40 from a first flow location 42 and out of the secondary outlet opening 38 along a second flow axis 44 from a second flow location 46. The flow axes 40 and 44 may or may not be parallel and may or may not extend in the same direction. In the example blower system 20, the housing structure 30 is configured such that second flow location 46 is located behind the first flow location 42 and the second flow axis 44 extends in substantially the same direction as, but is angled slightly downwardly with respect to, the first flow axis 40. The housing structure 30 is further configured such that the flow locations 42 and 46 are spaced from each other.

Figure 4:
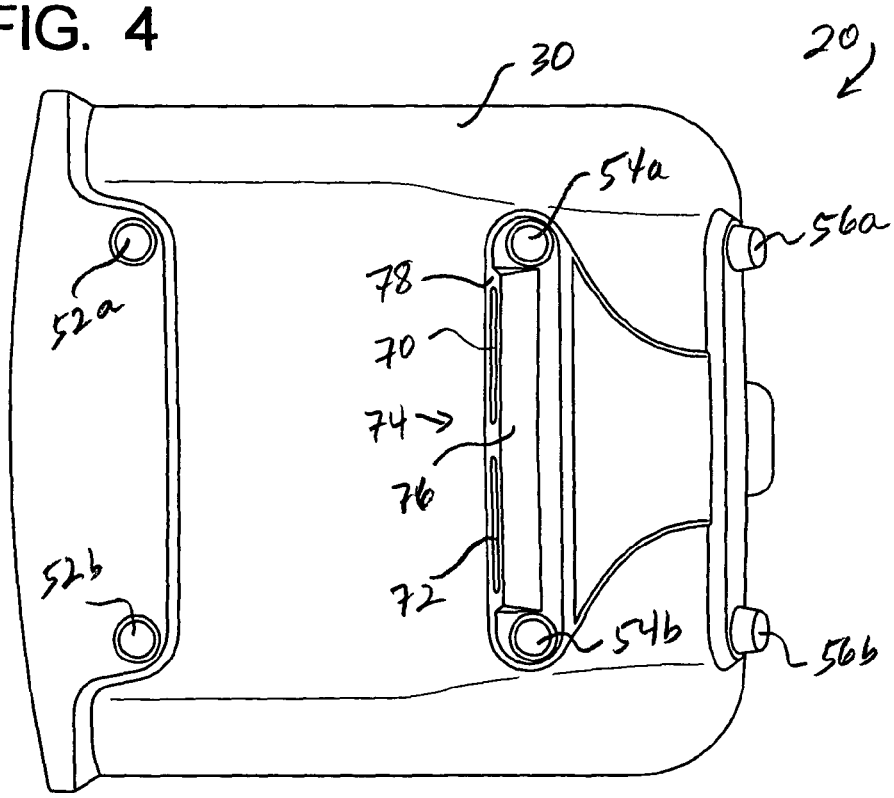
FIG. 4 is a bottom plan view of the blower system of FIG. 1.

During normal use, the blower system 20 is supported by a support surface 50 as shown in FIG. 2. FIGS. 1, 4, and 5 show that the housing assembly 22 comprises, in addition to the housing structure 30, a pair of front foot members 52*a* and 52*b*, a pair of intermediate foot members 54*a* and 54*b*, and a pair of rear foot members 56*a* and 56*b*. The blower system 20 is configured so that the system 20 may be supported on the support surface 50 either in a first support configuration by the front foot members 52*a,b* and the intermediate foot members 54*a,b* or in a second support configuration by the intermediate foot members 54*a,b* and the rear foot members 56*a,b*.

As shown in FIG. 5, the front foot members 52*a,b* and intermediate foot members 54*a,b* define a primary reference plane 60, while the intermediate foot members 54*a,b* and the rear foot members 56*a,b* define a secondary reference plane 62. When the blower system 20 is in the first support configuration, the primary reference plane 60 is generally parallel to the support surface 50. However, when the blower system 20 is in the second support configuration, the secondary reference plane 62 is generally parallel to the support surface 50.

The first flow axis 40 extends towards the front and is substantially parallel to the primary reference plane 60, while the second flow axis 44 extends towards the front and at an angle to the secondary reference plane 62. The first flow location 42 is arranged in front of the front foot members 52*a,b*, while the second flow location 46 is arranged between the front foot members 52*a,b* and the intermediate foot members 54*a,b*.

When the blower system 20 is supported by the support surface 50 in the first support configuration during normal use, a gap 64 is defined between the housing structure 30 and the support surface 50. The depth of the gap 64 depends upon factors such as the dimensions of the front and intermediate foot members 52*a,b* and 54*a,b*, the shape of the housing structure 30, and the material forming the support surface 50 (e.g., carpet, vinyl, etc.).

Accordingly, during normal use in the first support configuration, air flows out of the secondary outlet opening 38, into the gap 64, and along the support surface 50 underneath the blower system 20. The support surface 50 thus changes the flow of the air flowing out of the secondary opening 38 from along the second flow axis 44 to along a secondary flow path 66 along the support surface 50 within the gap 64. The air flow through the secondary outlet opening 38 thus moves along an inaccessible portion 68 of the support surface 50 below the blower system 20, allowing the drying of this inaccessible portion 68 of the support surface 50 also to be accelerated.

As generally described above, the blower system 20 causes relatively more air to flow out of the primary outlet opening 36 than the secondary outlet opening 38. In particular, the amount of air flowing out of the secondary outlet opening 38 should be substantially predetermined such that the inaccessible portion 68 of the support surface 50 dries at substantially the same rate as the portion of the support surface 50 in front of the primary outlet opening 36.

The example blower system 20 causes approximately 35 cubic feet per minute of air to flow out of the secondary outlet opening 38 during normal operation. This flow rate should be in a first preferred flow range of substantially between approximately 20 to 100 cubic feet per minute and in any event should be in a second preferred flow range of substantially between approximately 10 to 250 cubic feet per minute.

The relative sizes of the primary outlet opening 36 and the secondary outlet opening 38 affect the flow rate of air out of the secondary outlet openings 38. In the example blower system 20, the cross-sectional area of the primary outlet opening 36 is approximately 60 square inches, and the cross-sectional area of the secondary outlet opening 38 is approximately 1.5 square inches. In the example blower system 20, the secondary outlet opening 38 is thus approximately 3 percent of the size of the primary outlet opening 36. The size of the secondary outlet opening 38 relative to the primary outlet opening 36 should in any event be within a first preferred size range of substantially between approximately 1.5 percent and 5 percent and in any event should be within a second preferred size range of substantially between approximately 1 percent and 10 percent.

The shape of the secondary outlet opening 38 can also affect the flow rate out of the secondary outlet opening 38. In the example blower system 20, the secondary outlet opening 38 is formed by a plurality of elongate slots. In particular, the example secondary outlet opening 38 is formed by first and second secondary outlet slots 70 and 72, which are each approximately 3 inches long and ¼ inch wide.

The secondary outlet slots 70 and 72 are formed in a slot projection 74 that extends from the housing structure 30 between, but slightly in front of, the intermediate foot members 54*a* and 54*b*. More specifically, the slot projection 74 is formed by first and second walls 76 and 78 extending from the housing structure 30 into the gap 64. The first wall 76 is substantially parallel to the second flow axis 44, and the second wall 78 extends at an angle to the second flow axis 44. The secondary outlet slots 70 and 72 are formed in the second wall 78.

Referring again to FIG. 1 of the drawing, the construction of the example housing assembly 22 will now be described in further detail. The housing assembly 22 comprises an inlet screen 80 and an outlet screen 82. The screens 80 and 82 are or may be conventional and restrict access to the housing chamber 32 through the inlet openings 34 and the primary outlet opening 36. The housing assembly 22 further defines a handle portion 84 that is configured to facilitate hand-carrying of the blower system 20. A storage projection 86 extending from the handle portion 84 facilitates storage of the blower system 20.

The present invention may be implemented using housing assembly configurations other than the example housing assembly 22 described above. The scope of the present invention should thus be determined with reference to the following claims and not the foregoing description of the blower system 20.

What is claimed is:

1. A blower system comprising:

a housing having a housing chamber, at least one inlet opening, a primary outlet opening, and a secondary outlet opening: and a fan assembly mounted within the housing chamber, wherein:

operation of the fan assembly draws air into the housing chamber through the at least one inlet opening and forces air out of the housing chamber through at least one of the primary outlet opening and the secondary outlet opening, and further wherein a cross-sectional area of the secondary outlet opening is between approximately one percent and ten percent of a cross-sectional area of the primary outlet opening.

2. A blower system as recited in claim 1, in which operation of the fan assembly forces air out of both the primary outlet opening and the secondary outlet opening.

3. A blower system as recited in claim 1, in which the cross-sectional area of the secondary outlet opening is between approximately one and one-half percent and five percent of the cross-sectional area of the primary outlet opening.

4. A blower system as recited in claim 1, in which the cross-sectional area of the secondary outlet opening is approximately three percent of the cross-sectional area of the primary outlet opening.

5. A blower system as recited in claim 1, in which the primary opening defines a primary flow axis and the secondary outlet opening defines a secondary flow axis, where the secondary flow axis is angled with respect to the primary flow axis.

6. A blower system as recited in claim 1, in which the fan assembly causes approximately thirty-five cubic feet per minute of air to flow out of the secondary outlet opening.

7. A blower system as recited in claim 1, in which the fan assembly causes between approximately twenty to one hundred cubic feet per minute of air to flow out of the secondary outlet opening.

8. A blower system as recited in claim 1, in which the fan assembly causes approximately ten to two hundred and fifty cubic feet per minute of air to flow out of the secondary outlet opening.

9. A blower system as recited in claim 1, further comprising first and second pairs of foot members, where the secondary opening is arranged such that air exits the housing between the first and second pairs of foot members.

10. A blower system comprising:

a housing having a housing chamber, at least one inlet opening, a primary outlet opening, and a secondary outlet opening;

a fan assembly mounted within the housing chamber;

first, second, and third pairs of foot members, wherein the first and second pairs of foot members define a first reference plane, and the second and third pairs of foot members define a second reference plane, wherein the second reference plane is angled with respect to the first reference plane;

wherein operation of the fan assembly draws air into the housing chamber through the at least one inlet opening and forces air out of the housing chamber through at least one of the primary outlet opening and the secondary outlet opening; and wherein air flowing out of the primary outlet opening flows along a primary flow axis that is generally parallel to the first reference plane.

11. A blower system as recited in claim 10, in which air flowing out of the secondary outlet opening flows along a secondary flow axis, where the secondary flow axis is angled with respect to the first reference plane.

12. A method of causing air to flow along a target surface, comprising the steps of:

positioning a housing proximate to the target surface, the housing having a housing chamber, at least one inlet opening, a primary outlet opening, and a secondary outlet opening, the housing carrying a fan assembly and first, second, and third pairs of foot members, wherein the first and second pairs of foot members define a first reference plane, the second and third pairs of foot members define a second reference plane, and the second reference plane is angled with respect to the first reference plane;

arranging the housing in a first orientation with respect to the target surface such that the first and second sets of foot members engage the target surface;

arranging the housing in a second orientation with respect to the target surface such that the second and third sets of foot members engage the target surface; and operating the fan assembly such that air is drawn into the housing chamber through the at least one inlet opening and forced air out of the housing chamber through the primary outlet opening and the secondary outlet opening.

13. A method as recited in claim 12, in which the step of providing the housing comprises the step of making a cross-sectional area of the secondary outlet opening smaller than a cross-sectional area of the primary outlet opening.

14. A method as recited in claim 12, in which the step of providing the housing comprises the steps of:

defining a primary flow axis along which air exiting the primary outlet opening flows;

defining a secondary flow axis along which air exiting the secondary outlet opening flows; and angling the secondary flow axis with respect to the primary flow axis.

15. A method as recited in claim 12, further comprising the steps of:

arranging the first and second pairs of foot members on the housing; and arranging the secondary opening such that air exits the housing between the first and second pairs of foot members.

16. A method as recited in claim 15, further comprising the step of configuring the first and second pairs of foot members such that a gap exists between the housing and the target surface, where air flowing out of the secondary outlet opening flows into the gap.

17. A blower system comprising:

a housing having a housing chamber, at least one inlet opening, a primary outlet opening, and a secondary outlet opening; and a fan assembly mounted within the housing chamber;

first and second pairs of foot members that define a reference plane; wherein:

the primary opening defines a primary flow axis and the secondary outlet opening defines a secondary flow axis, where the secondary flow axis is angled with respect to the primary flow axis;

operation of the fan assembly draws air into the housing chamber through the at least one inlet opening and forces air out of the housing chamber through the primary outlet opening and the secondary outlet opening, wherein air flowing out of the primary outlet opening flows along a primary flow axis that is generally parallel to the reference plane.

18. A blower system as recited in claim 17, in which a cross-sectional area of the secondary outlet opening is smaller than a cross-sectional area of the primary outlet opening.

* * * * *

UNITED STATES PATENT AND TRADEMARK OFFICE

CERTIFICATE OF CORRECTION

PATENT NO. : 7,785,064 B2
APPLICATION NO. : 11/642006
DATED : August 31, 2010
INVENTOR(S) : Brett Bartholmey et al.

It is certified that error appears in the above-identified patent and that said Letters Patent is hereby corrected as shown below:

In column 4, line 59, in claim 1, delete "opening:" and insert -- opening; --, therefor.

Signed and Sealed this
Twenty-fifth Day of January, 2011

David J. Kappos

David J. Kappos
*Director of the United States Patent and Trademark Office*